United States Patent [19]

Yoshinaga et al.

[11] 4,406,273

[45] Sep. 27, 1983

[54] IGNITION SYSTEM FOR INTERNAL COMBUSTION ENGINE

[75] Inventors: Toru Yoshinaga, Okazaki; Toshihiko Igashira, Toyokawa; Kouichi Mori, Okazaki; Hisasi Kawai, Toyohashi; Seiji Morino, Aichi, all of Japan

[73] Assignee: Nippon Soken, Inc., Nishio, Japan

[21] Appl. No.: 266,043

[22] Filed: May 21, 1981

[30] Foreign Application Priority Data

May 29, 1980 [JP] Japan ..... 55-72275

[51] Int. Cl.[3] ..... F02P 9/00

[52] U.S. Cl. ..... 123/625; 123/629; 123/651; 123/656; 315/209 T

[58] Field of Search ..... 123/609, 610, 625, 626, 123/629, 651, 656; 315/209 T

[56] References Cited

U.S. PATENT DOCUMENTS 3,412,723 11/1968 Huntzinger et al. ..... 315/209 SC 3,896,776 7/1975 Ford ..... 123/651

4,176,644 12/1979 Hellberg et al. ..... 123/625

FOREIGN PATENT DOCUMENTS 1334230 10/1973 United Kingdom ..... 123/625

*Primary Examiner*—Charles J. Myhre

*Assistant Examiner*—Andrew M. Dolinar

*Attorney, Agent, or Firm*—Cushman, Darby & Cushman

[57] ABSTRACT

An ignition system for the internal combustion engine comprising a high voltage circuit for generating a spark, having the primary and secondary windings. In response to a first signal, the current in the primary winding is cut off thereby to generate a high voltage at the secondary winding. In response to a subsequent second signal, the primary winding is shorted thereby to cut off the high voltage thus far generated in the secondary winding, thus properly regulating the duration of the spark generated.

4 Claims, 5 Drawing Figures

IGNITION SYSTEM FOR INTERNAL COMBUSTION ENGINE

BACKGROUND OF THE INVENTION

1. Field of the Invention

This invention relates to an ignition system for the internal combustion engine, or more in particular to a spark duration control system.

In a spark ignition engine, ignition is difficult under the conditions of low speed and small load because of a considerable amount of residual combusted gas. In view of the recent demand of the purification of the exhaust gas and the use of a leaner mixed gas, on the other hand, the importance of improving the ignition performance at the low speed under small load is increasing.

One of the existing methods to cope with this problem consists in lengthening the duration of the spark. If the spark life is lengthened to about 3 msec, for instance, the ignition ability is improved greatly under the above-mentioned conditions as known well.

Such a long spark duration, however, is not only useless under the condition of high speed or large load where the ignition characteristic is excellent but also greatly expedites the wear of the electrode of the ignition plug.

Our researches show that the wear of the electrode of the ignition plug is largely attributable to the discharge after the top dead center (TDC) for compressive motion of the piston of the internal combustion engine, while the discharge before the top dead center for compressive motion does not substantially contribute to the wear of the electrode. This is considered due to the fact that the discharge under a high pressure, high temperature and a flame accelerates the electrode wear.

Our researches also revealed that the discharge after the compression top dead center did not contribute to the ignition at all.

Thus an ignition system is required by which the spark is not kept on after the top dead center for compression and the spark is kept on as long as possible under the conditions of low speed and low load.

2. Description of the Prior Art

A system similar to the present invention is disclosed conventionally by the U.S. Pat. No. 3,896,776. This system is such that the primary coil is cut off only during the period from ignition to the top dead center while the primary coil is supplied with power for all the other periods. According to the characteristic diagram of this system, for the revolutional speed of 6000 rpm, the engine is ignited for every half a revolution thereof. In this case, the primary coil is turned on for about 4.3 ms and turned off for 0.7 ms, resulting in the off-time to on-time ratio of 16%. The situation becomes worse when the engine revolutional speed is reduced to 600 rpm, where the on-time of 48.3 ms and the off-time of 1.7 ms are involved, thus leading to the off-time to on-time ratio of 3.5%. This excessive length of on-time will heat and finally burn the ignition coil. This conventional system, therefore, cannot be actually mounted for use on the automobile.

SUMMARY OF THE INVENTION

An object of the present invention is to provide an ignition system comprising a high voltage circuit having primary and secondary windings for generating a spark, in which the primary current is cut off by a first signal thereby to generate a high voltage across the secondary winding, and the primary winding is subsequently shorted by a second signal thereby to cut off the high voltage thus far generated in the secondary winding, thus properly regulating the duration of the spark generated.

Another object of the present invention is to provide an ignition system in which the spark duration under the condition of low speed or low load is long while the spark duration at high speeds or large load is ended at a particular angle approximate to the compression top dead center.

DESCRIPTION OF THE PREFERRED EMBODIMENTS

Figure 1:
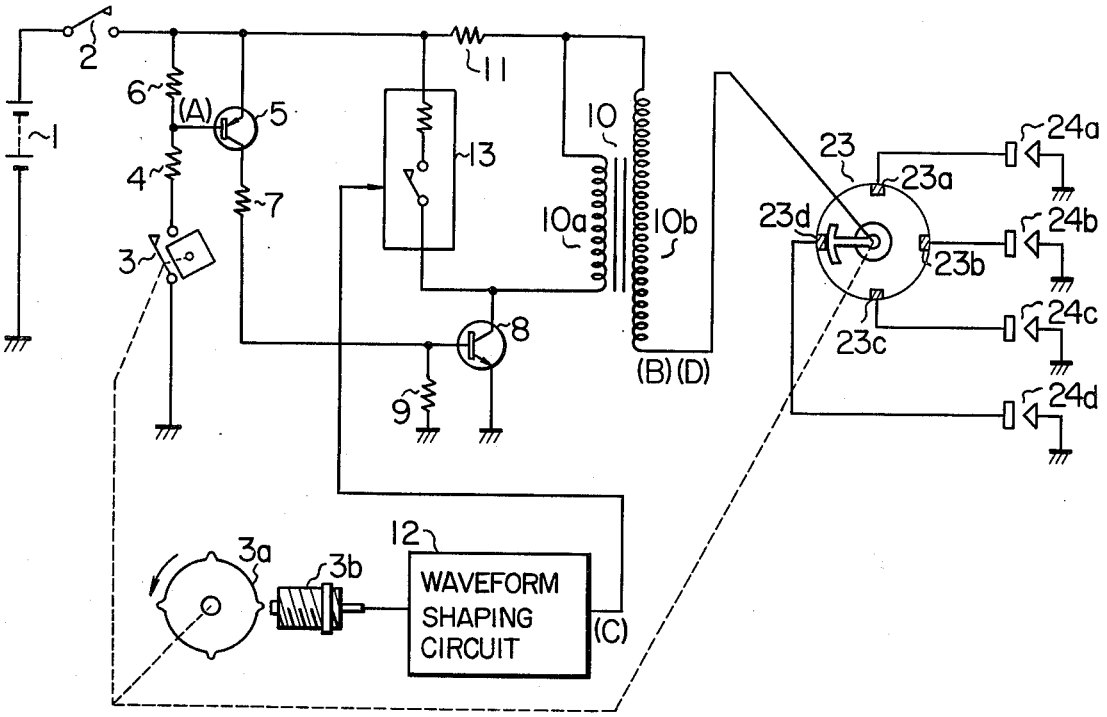
FIG. 1 is an electrical circuit diagram showing an embodiment of the ignition system according to the present invention.

An electrical circuit diagram of an ignition system for the internal combustion engine according to an embodiment of the present invention is shown in FIG. 1.

In FIG. 1, reference numeral 1 designates a battery with the negative electrode thereof grounded. Numeral 2 is a key switch with an end thereof connected to the positive electrode of the battery 1. Numeral 3 is a breaker contact contained in a distributor, and has an end thereof grounded, the other end thereof being connected to an end of a resistor 4. The other end of the resistor 4 is connected to the base of a PNP transistor 5. The emitter of the transistor 5 is connected to the other end of the key switch 2. The resistor 6 is inserted between the emitter and the base of the transistor 5. The collector of the transistor 5 is connected to end of the resistor 7, the other end of which is connected to the base of the NPN power transistor 8 as ignition interrupting means. The emitter of the power transistor 8 is grounded. A resistor 9 is inserted between the base and emitter of the power transistor 8. The collector of the power transistor 8 is connected to an end of the primary winding 10*a* of the ignition coil 10. The other end of the primary winding 10*a* of the ignition coil 10 is connected, together with an end of the secondary winding 10*b*, to an end of the resistor 11. The other end of the resistor 11 is connected to the other end of the key switch 2. Numeral 3*a* designates a disc of magnetic material contained in the distributor. This embodiment is used with a 4-cylinder internal combustion engine and therefore has a protrusion at four points on the outer periphery of the disc 3 corresponding to the top dead center of the respective cylinders. These protrusions are detected by a sensor 3*b*. The sensor 3*b* is formed of a magnet pick-up available on the market. The output of the sensor 3*b* is connected to a waveform shaping circuit 12. The waveform shaping circuit 12 includes an amplifier for amplifying the signal from the sensor 3*b*, a comparator for cutting off the output of the amplifier at a predetermined threshold level and producing corresponding pulses, and a monostable multivibrator for producing a pulse of a predetermined width in response to the output of the comparator. Numeral 13 shows a shorting circuit which is so constructed as to be turned on in response to a high-level output from the waveform shaping circuit 12 and turned off in response to a low level output therefrom.

The fixed electrodes of the high voltage distributor 23 are provided at four points, of which the fixed electrode 23*a* is connected to the spark plug 24*a* (for the first cylinder), the fixed electrode 23*b* to the spark plug 24*b* (for the third cylinder), the fixed electrode 24*c* to the spark plug 24*c* (the for the fourth cylinder) and the fixed electrode 24*d* to the spark plug 24*d* (for the second cylinder) respectively.

The operation of the ignition system of the internal combustion engine according to the present invention having the above-described construction will be described briefly. When the key switch 2 is closed, the distributor breaker contact 3 is opened and closed by a cam since the engine is running. When the breaker contact 3 is closed, the transistor 5 conducts so that current flows through the resistor 7 and the base and emitter of the power transistor 8. Thus the power transistor 8 is turned on so that the current flows in the primary winding 10*a* of the ignition coil 10 as a load. When the breaker contact 2 opens at the next moment, the transistor 5 is turned off and therefore the primary current of the ignition coil 10 is cut off. At this moment, a high voltage is generated in the secondary winding 10*b* thereby to generate an ignition spark at one of the spark plugs 24*a*, 24*b*, 24*c* and 24*d*.

Figure 2:
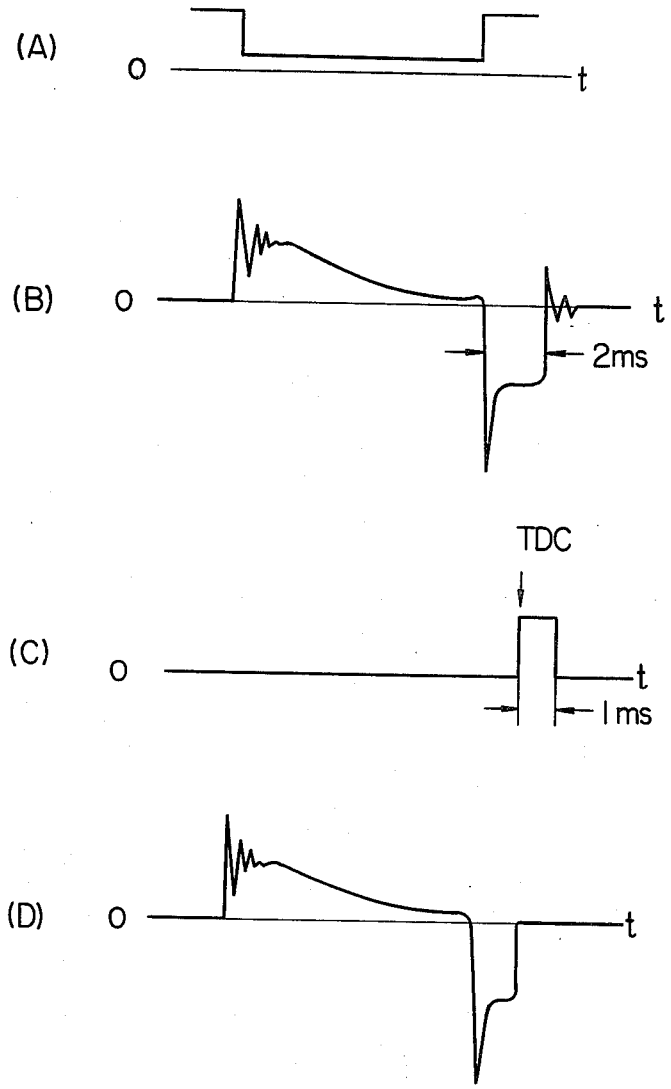
FIG. 2 shows waveforms generated by the various parts for explaining the operation of the ignition system shown in FIG. 1.

The diagram of FIG. 2 shows waveforms generated at various parts of the system shown in FIG. 1. Specifically, FIG. 2(A) shows a base waveform of the transistor 5, and FIG. 2(B) shows a high voltage waveform generated at the secondary side of the ignition coil 10 when the shorting circuit 13 is not operating.

The signal from the disc 3*a* rotated in synchronism with the cam for the breaker contact 3 is detected by the sensor 3*b* and applied through the waveform shaping circuit 12 thereby to produce a pulse waveform shown in FIG. 2(C). It is sufficient if the width of the pulse is about 1 ms. When the pulse from the waveform shaping circuit 12 is applied to the shorting circuit 13, the shorting circuit 13 is turned on. The primary winding 10*a* of the ignition coil 10 is substantially shorted through the resistor 11 and the internal load of the shorting circuit 13. The magnetic energy remained for spark discharge is discharged upon shorting of the primary winding 10*a*. The high voltage generated in the secondary winding 10*b* of the ignition coil 10 is cut off thereby to stop the spark discharge. The high voltage waveform generated at the secondary side at that time is shown in FIG. 2(D). In this case, ignition starts normally at about 10 degrees before the top dead center (BTDC) and in the absence of the shorting circuit 13, the spark discharge continues for about 2 ms. When the engine reaches a high rotational speed or a high load, the ignition start timing advances, but since the discharge time is fixed, the spark discharge which tends to effectively continue even after the top dead center (TDC) is cut off.

Figure 3:
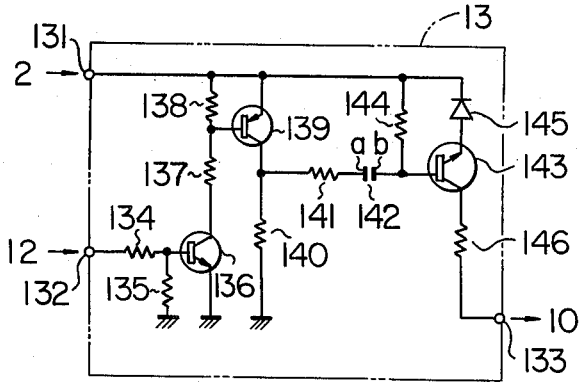
FIG. 3 is a diagram specifically showing the shorting circuit in the ignition system of FIG. 1.

An embodiment of the shorting circuit 13 of FIG. 1 is shown in detail in FIG. 3. The terminal 131 is connected to the key switch 2, and the input terminal 132 is connected to the output of the waveform shaping circuit 12. The output terminal 133 is connected to the terminal of the primary of the ignition coil 10 not on the power supply side (which is connected to the collector of the power transistor 8). The input terminal 132 is connected through the resistor 134 to the base of the transistor 136. The emitter of the transistor 136 is grounded. The collector of the transistor 136 is connected through a resistor 137 to the base of the transistor 139. The emitter of the transistor 139 is connected to the terminal 131. A resistor 138 is inserted between the terminal 131 and the base of the transistor 139. The collector of the transistor 139 is grounded through a resistor 140. An end of the resistor 141 is connected to the collector of the transistor 139, and the other end thereof is connected to an end of the capacitor 142. The other end of the capacitor 142 is connected to the base of the transistor 143. The emitter of the transistor 143 is connected to the anode of the diode 145. The cathode of the diode 145 is connected to the terminal 131. The resistor 144 is inserted between the base of the transistor 143 and the terminal 131. The collector of the transistor 143 is connected to the output terminal 133 through a resistor 146.

The operation of the shorting circuit 13 having the above-mentioned configuration will be briefly explained.

Assume that the key switch 2 is closed so that the battery voltage is applied to the terminal 131. Since the transistors 136 and 139 are in off state, the capacitor 142 is reduced to the earth potential at the a side thereof through the resistors 140 and 141. The b side of the capacitor 142, on the other hand, assumes the battery voltage (12 V) through the resistor 144. When the output of the waveform shaping circuit 12 changes from low to high level, the transistor 136 is turned on thereby to turn on the transistor 139. The collector of the transistor 139 assumes a voltage substantially equal to the battery voltage of 12 V. The potential at the b side of the capacitor 142 assumes about 24 V, so that current flows through the base and emitter of the transistor 143 and the diode 145, thus turning on the transistor 143. The turn-on time of the transistor 143 is determined by the time constant due to the resistor 141 and the capacitor 142. It should be noted here that while the ignition plug is discharging in spark, a reverse electromotive force is generated in the primary winding 10*a* of the ignition coil 10 and therefore the power supply side thereof stands at 12 V and the collector side of the transistor 8 at about 24 V. Thus upon the turning on of the transistor 143, the reverse electromotive force generated in the primary winding 10*a* is substantially shorted through the transistor 143, the resistors 146 and 11 and the diode 145.

Figure 4:
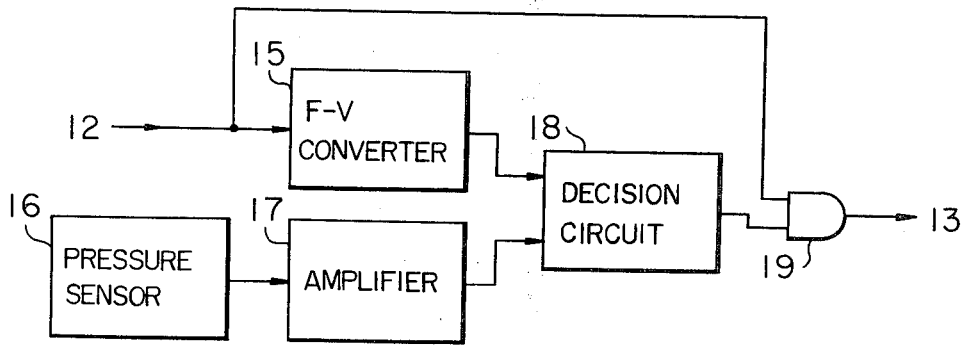

Another embodiment of the configuration of the essential parts of the present invention is shown in FIG. 4 in the form of a block diagram illustrating an electronic circuit for generating a signal for stopping the spark discharge in accordance with the engine r.p.m. and the engine load. Numeral 15 is an F-V converter for converting the pulse signal generated by the waveform shaping circuit 12 into an analog voltage. Numeral 16 is a pressure sensor of a semiconductor integrated circuitry for detecting the pressure in the intake manifold. Numeral 17 designates an amplifier for amplifying the output signal from the pressure sensor 16, which amplifier 17 produces a low analog signal in response to a high pressure of the intake manifold (low load) and a high analog voltage in response to a low pressure of the intake manifold (high load). Numeral 18 designates a decision circuit including a circuit for determining whether the engine rotational speed is higher or lower than a set r.p.m., a circuit for determining whether the pressure is higher or lower than a setting and an OR circuit. When the engine rotational speed is higher than the set r.p.m. or the engine load is higher than a setting, the decision circuit 18 produces a high level signal, and vice versa. Numeral 19 shows an AND circuit supplied with the outputs of the decision circuit 18 and the waveform shaping circuit 12 shown in FIG. 1. If the circuit shown by the block diagram of FIG. 4 is inserted between the waveform shaping circuit 12 and the shorting circuit 13 shown in FIG. 1, the TDC signal from the waveform shaping circuit 12 is applied only when the engine rotational speed is high or the engine load is high, thus activating the shorting circuit 13. Under the other engine condition such as low load and low speed condition where ignition timing is retarded close to the top dead center, the output of the decision circuit 18 is kept low, so that the signal from the waveform shaping circuit 12 is blocked by the AND circuit 19, thus preventing the shorting circuit 13 from being activated.

In the above-described embodiments, the top dead center (TDC) is positioned at the shorting angle of the primary winding. Instead, it is of course possible to provide the primary winding shorting angle at an angle of the combustion start point near the top dead center.

Figure 5:
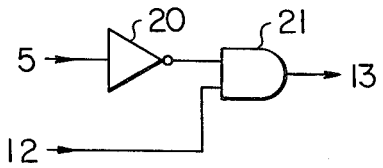
FIGS. 4 and 5 are block diagrams showing two examples of circuits added to the system of FIG. 1.

Also, as shown in FIG. 5, the output of the transistor 5 may be applied through the inverter 20 to the AND circuit 21, together with the output signal of the waveform shaping circuit 12, so that the signal from the waveform shaping circuit 12 is prevented from being applied to the shorting circuit 13 when the output of the transistor 5 is at high level to energize the primary winding 10*a*. In this way, energy may continue to be stored in the primary winding of the ignition coil, thus enabling the ignition to occur after the top dead center position at certain engine conditions.

It will be understood from the foregoing description that according to the present invention there is provided an ignition system for the internal combustion engine comprising primary and secondary windings, a high voltage being generated in the secondary winding by cutting off the current in the primary winding thereby to generate an ignition spark in the ignition plug, wherein the primary winding is provided with a shorting circuit which is activated near the top dead center (TDC) while a high voltage generated in the secondary winding. Thus the generation of the high voltage at the secondary winding can be stopped at will, so that the unnecessary spark is prevented from being generated in the ignition plug, thus minimizing the consumption of the ignition plug.

Especially, if the primary winding is energized by the signal generated at a specific timing at or near the compression top dead center of the piston, the spark after the top dead center which is not necessary for ignition but considerably contributes to the wear of the ignition spark plug is prevented from being generated, thus preventing the unnecessary wear of the ignition plug. This effect is especially conspicuous under the high speed and high load conditions of the internal combustion engine where the electrode is worn greatly, while at the same time maintaining the ignition capability for low speed and small load where the ignition timing is earlier.

Further, if the primary winding is energized when the ignition interrupting means is closed, energy is prevented from being stored in the primary winding of the ignition coil or the battery form being shorted when the ignition interrupting means is closed.

We claim:

1. An ignition system for an internal combustion engine having an output shaft rotated by the combustion of combustible mixture ignited by a spark, said ignition system comprising:

a power supply source;

an ignition coil having primary and secondary windings, said primary winding being connected to said power supply source and said secondary winding generating a spark voltage when said primary winding is deenergized;

a spark plug connected to said secondary winding to be supplied with said spark voltage to thereby ignite the combustible mixture of said internal combustion engine;

first switching means connected in series with said primary winding for energizing and deenergizing said primary winding by said power supply source in response to the conduction and nonconduction thereof, respectively;

second switching means connected in parallel with said primary winding for preventing said secondary winding from generating said spark voltage in response to the conduction thereof; and control means connected to said second switching means for switching said second switching means from nonconduction to conduction at a selected instant in time after the generation of said spark voltage, said second switching means including:

a first series circuit comprising a first resistor, a capacitor and a second resistor, said series circuit being connected across said power supply source for forming a charging circuit for said capacitor;

a first transistor having a base separatively connected to said control means and an emitter-collector path connected in parallel with said first resistor and said capacitor;

a second transistor having a base connected to a juncture of said first resistor and said capacitor and having a collector-emitter path;

a second series circuit comprising a third resistor, said collector-emitter path of said second transistor and a diode, said second series circuit being connected across said primary winding, whereby the reverse emf generated in said primary winding is substantially shorted through said second series circuit when said collector-emitter path is conductive, an emitter of said first transistor being connected to a cathode of said diode for forming a discharge circuit for said capacitor, whereby a discharge of said capacitor begins when said emitter-collector path of said first transistor becomes conductive.

2. An ignition system according to claim 1, wherein said control means comprises:

a position detector associated with said output shaft for generating an output signal in response to the arrival of said output shaft at a predetermined angular position close to the top dead center position of said output shaft; and a circuit connected to said position detector for switching said second switching means from the nonconduction to the conduction in response to said output signal of said position detector.

3. An ignition system according to claim 2, further comprising:

speed detecting means for detecting the rotation speed of said output shaft;

load detecting means for detecting the load of said internal combustion engine; and means connected to said speed deteciting means and said load detecting means for preventing said output signal from being applied to said second switching means when both of said detected rotation speed and load are below respective predetermined values.

4. An ignition system according to claim 2 further comprising:

means for preventing said output signal from being applied to said second switching means when said first switching means is kept conductive.

* * * * *